United States Patent [19]

Kourimsky et al.

[11] Patent Number: 5,022,867

[45] Date of Patent: Jun. 11, 1991

[54] ELECTRICAL TERMINAL

[75] Inventors: Friedrich J. A. Kourimsky, Bensheim; Paul E. Romak, Langen, both of Fed. Rep. of Germany

[73] Assignee: AMP Incorporated, Harrisburg, Pa.

[21] Appl. No.: 365,280

[22] Filed: Jun. 12, 1989

[51] Int. Cl.[5] ..... H01R 4/24

[52] U.S. Cl. ..... 439/395

[58] Field of Search ..... 439/389, 391, 392, 395, 439/396, 397, 400, 406, 407, 409, 410, 417, 418, 421, 426

[56] References Cited

U.S. PATENT DOCUMENTS

| | | | |
|---|---|---|---|
| 3,760,331 | 9/1973 | Gurley | 439/391 |
| 3,937,549 | 2/1976 | Hughes | 339/97 C |
| 4,324,450 | 4/1982 | Weisenberger et al. | 339/97 R |
| 4,438,997 | 3/1984 | Evans | 339/97 R |
| 4,806,120 | 2/1989 | Baker | 439/339 |

FOREIGN PATENT DOCUMENTS

| | | | |
|---|---|---|---|
| 1926748 | 11/1970 | Fed. Rep. of Germany | 439/421 |
| 0245985 | 5/1987 | Fed. Rep. of Germany | 439/395 |
| 1407693 | 9/1975 | United Kingdom | 439/421 |

*Primary Examiner*—Joseph H. McGlynn
*Assistant Examiner*—Hien D. Vu
*Attorney, Agent, or Firm*—Bruce J. Wolstoncroft; Eric J. Groen

[57] ABSTRACT

An electrical terminal is shown which includes an insulation displacement type slot which is useable with stranded wire. The insulation displacement slot has two plates at each end of a base portion which are folded up to face one another. The plates form open slots for the receipt of the insulated stranded wire, and the plates are rotatable one towards the other, to bring side edges of the plates through the insulation and against the individual conductor strands for termination therewith. The side edges of the plate portions are formed into arcuate sections which prevent lateral movement of the strands within the slots.

6 Claims, 7 Drawing Sheets

10
6
18
14
60
64
20
62
16
12
8
6

ELECTRICAL TERMINAL

BACKGROUND OF THE INVENTION

1. Field of the Invention

The subject application relates to electrical terminals for electrical connectors where the electrical connection between the electrical conductor and the electrical terminal is by means of an insulation displacement slot.

2. Discussion of the Prior Art

Many electrical connectors utilize insulation displacement slots, the so called IDC technology for interconnection of electrical wires to electrical terminals. A typical IDC slot consists of at least one plate where the plate includes a slot for the receipt of an insulated conductor in a transverse relation relative to the slot. The slot is sized for receipt of a solid conductor such that the conductor is interferingly fit within the slot. The movement of the wire into the slot causes the edges of the slot to shear through the insulation to a point where the slot edges engage the conductor and thereby effect the electrical connection between the conductor and the electrical terminal. Such IDC technology is exemplified by U.S. Pat. No. 3,145,261. Improvements to such technology have included the incorporation of double slotted plates where the two plates are interconnected by a bight portion, such technology as shown in U.S. Pat. No. 3,824,530.

The slotted plate type of electrical terminal discussed above, is typically not adequate for the use of terminating electrical conductors of the type which include a plurality of small conductors within a single unitary insulating jacket, typically referred to as stranded wire. The slotted plate type electrical terminal is not useful for such terminations because the stranded wires tend to migrate along the slot length rather than remaining in a defined bundle. This causes the electrical conductors to break electrical connection between the conductors and the edges of the IDC slots.

An electrical terminal which can be used for stranded wire is shown in U.S. Pat. No. 4,324,450 and includes folded over jaws which form two bisecting slots for receiving the stranded wires therein. A disadvantage to such a design is that the design is cumbersome and costly to manufacture. Furthermore, the design is complex and requires a spacious profile to adequately terminate conductors. This complex design is also adverse to the inclusion of a further contact which would make contact to another wire, to a pin or a socket type terminal.

Any of the prior terminals discussed above include two edges which form the slot for electrical termination. A wire to be terminated is moved laterally into the slot for electrical termination.

SUMMARY OF THE INVENTION

An object of the invention is therefore to design an electrical insulation displacement slot which can be used to terminate a stranded electrical conductor. The slot should be adequate for use with an electrical terminal where the terminal includes a further contact member such as a pin or socket. In accordance with the object of the invention, the instant invention includes an insulation displacement type electrical terminal comprising at least two edges forming the slot where an insulated conductor can be moved laterally into the slot for electrical termination, the terminal being characterized in that the slot is comprised of at least two plate members which are moveable one towards the other to decrease the slot width.

In the preferred embodiment of the invention the plates are rotateable about an axis which is perpendicular to the plane of the plates.

In the preferred embodiment of the invention the edges of the plates are arcuately shaped to form two concave edges facing each other.

In the preferred embodiment of the invention the terminal is formed from a base portion having the two plates upstanding from an edge of the base portion.

In the preferred embodiment of the invention the base portion is bent across its width at a position intermediate to the two plate portions.

An inventive method of terminating an insulated wire into the terminal is characterized by the steps of:

moving a wire laterally into the slot between the edges of the plates; and moving the plate portions one towards the other to sever the insulation of the insulated wire and to make contact between the edges of the plates and the conductor of the insulated wire.

BRIEF DESCRIPTION OF THE DRAWINGS

FIG. 3 is a view similar to that of FIGS. 1 and 2 showing the insulation displacement slot in a closed configuration such that the edges of the insulation displacement slot are in contact with the stranded conductors of the insulated wire.

DETAILED DESCRIPTION OF THE PREFERRED EMBODIMENT

Figure 1:
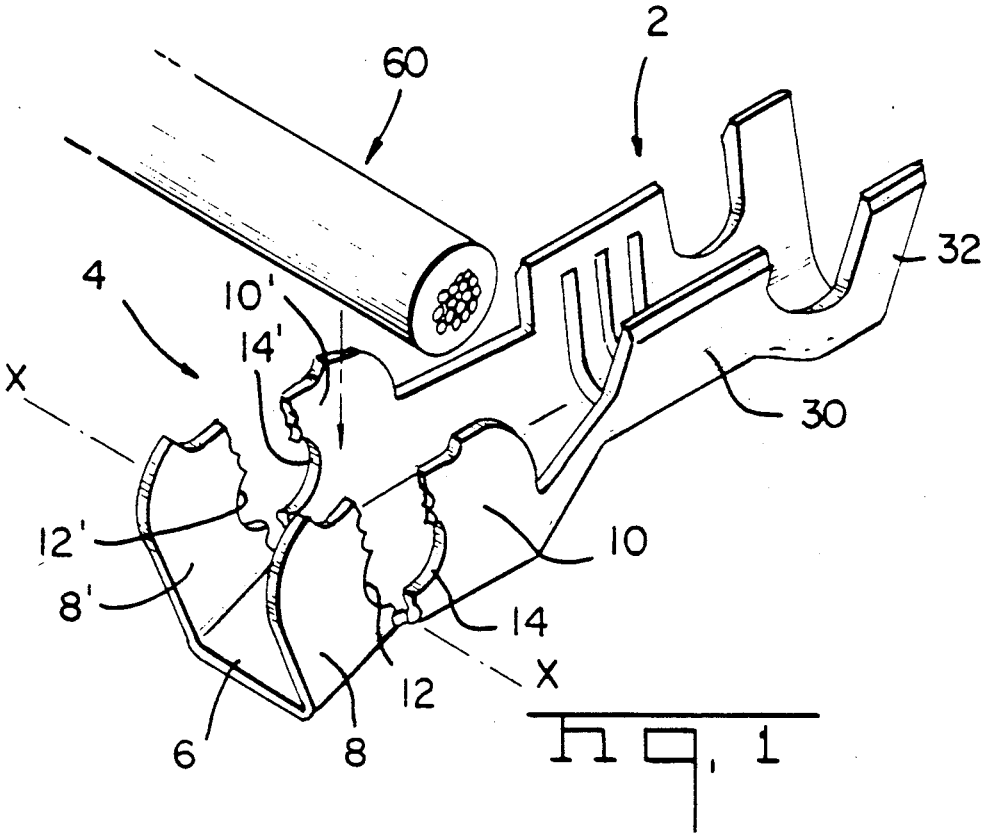
FIG. 1 is an isometric view of the electrical terminal of the subject invention showing an insulated wire poised above the slot of the terminal.
Figure 4:
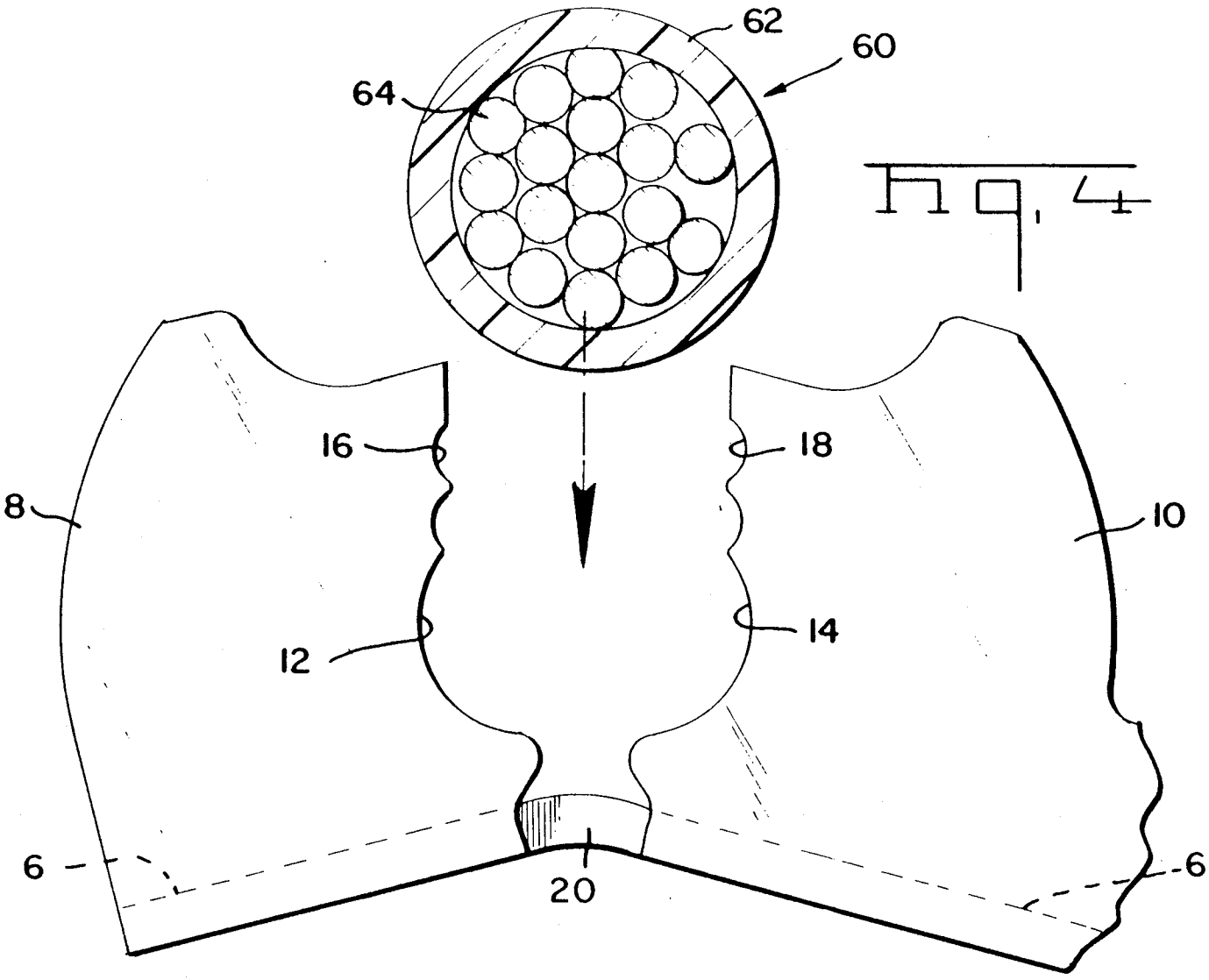
FIG. 4 is a front view of the insulation displacement slot of the subject invention prior to insertion of the insulated conductor into the insulation displacement slot.
Figure 8:
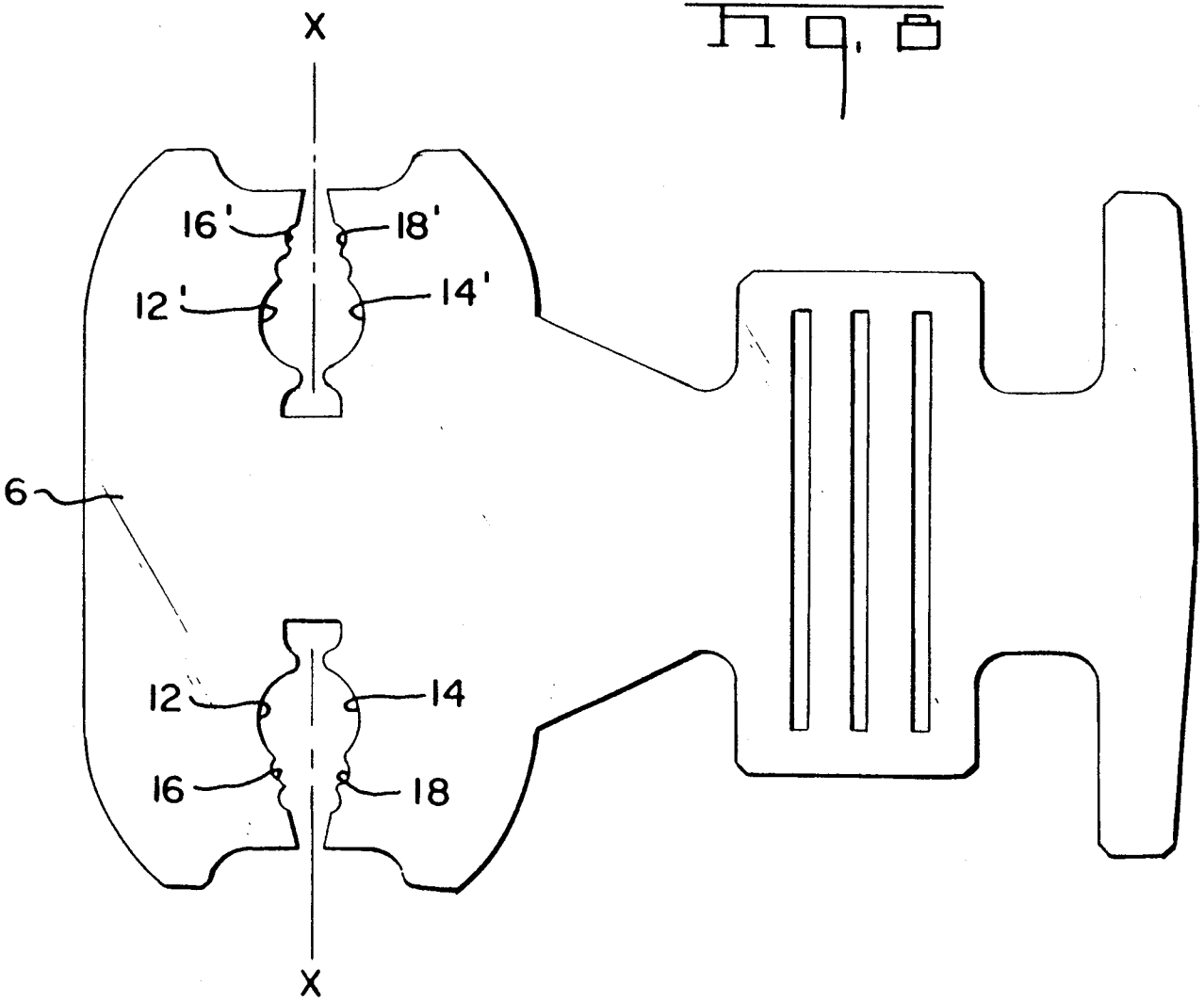
FIG. 8 is a view of the flat blank of the inventive terminal.

With reference first to FIG. 1, an electrical terminal 2 is shown which includes an insulation displacement slot shown generally as 4. The insulation displacement slot comprises a base portion, such as 6, with plate portions 8 and 10 extending from one side edge of the base portion 6 and plate portions 8' and 10' extending upwardly from the opposite side edge. The plate portions 8, 10 and 8', 10' upstand substantially perpendicular to the plane of the base portion 6. The plate portions include side edges 12, 14 and 12', 14' which are arcuately shaped to define two concave edges facing each other, as best shown in FIG. 4. These side edges of the plates further include serrated edges 16, 18 which are disposed respectively above the arcuate side edge portions 12, 14. As best shown in FIG. 4, the base portion 6 is bent at 20 and is rotateable about axis X—X, shown in FIG. 1. The terminal is also shown in FIG. 8 in the flat blank condition, subsequent to the stamping of the terminal, but prior to the forming the blank into its final configuration.

Figure 2:
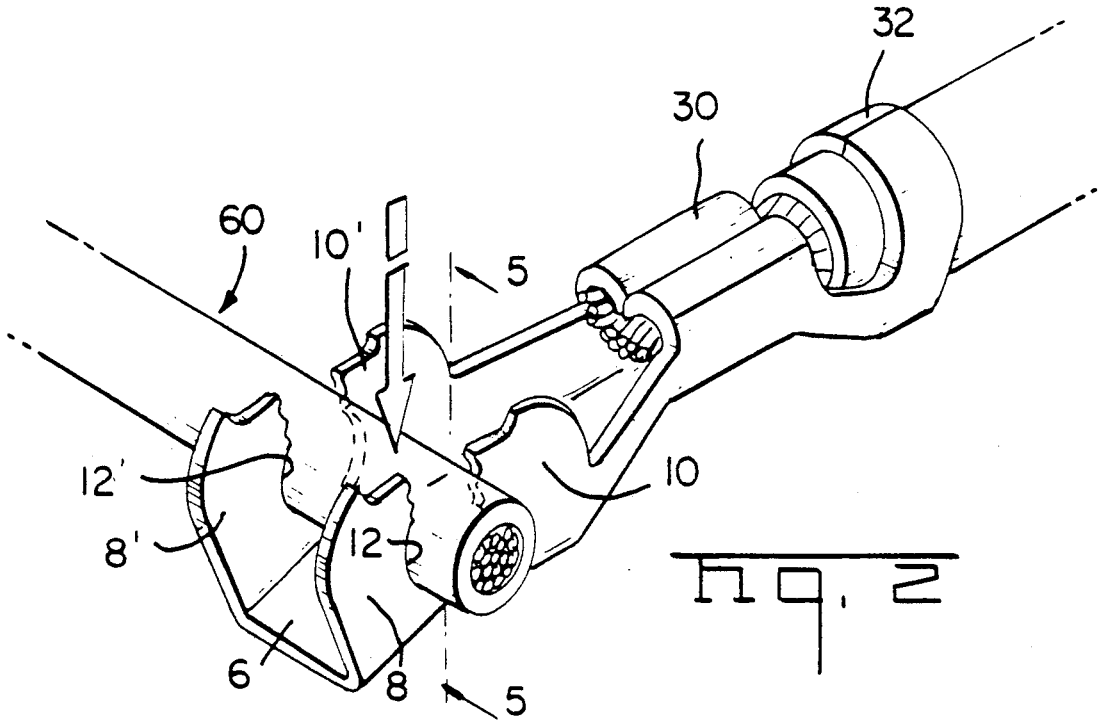
FIG. 2 is a view similar to that of FIG. 1 showing the insulated conductor moved laterally into the insulation displacement slot area.
Figure 1:
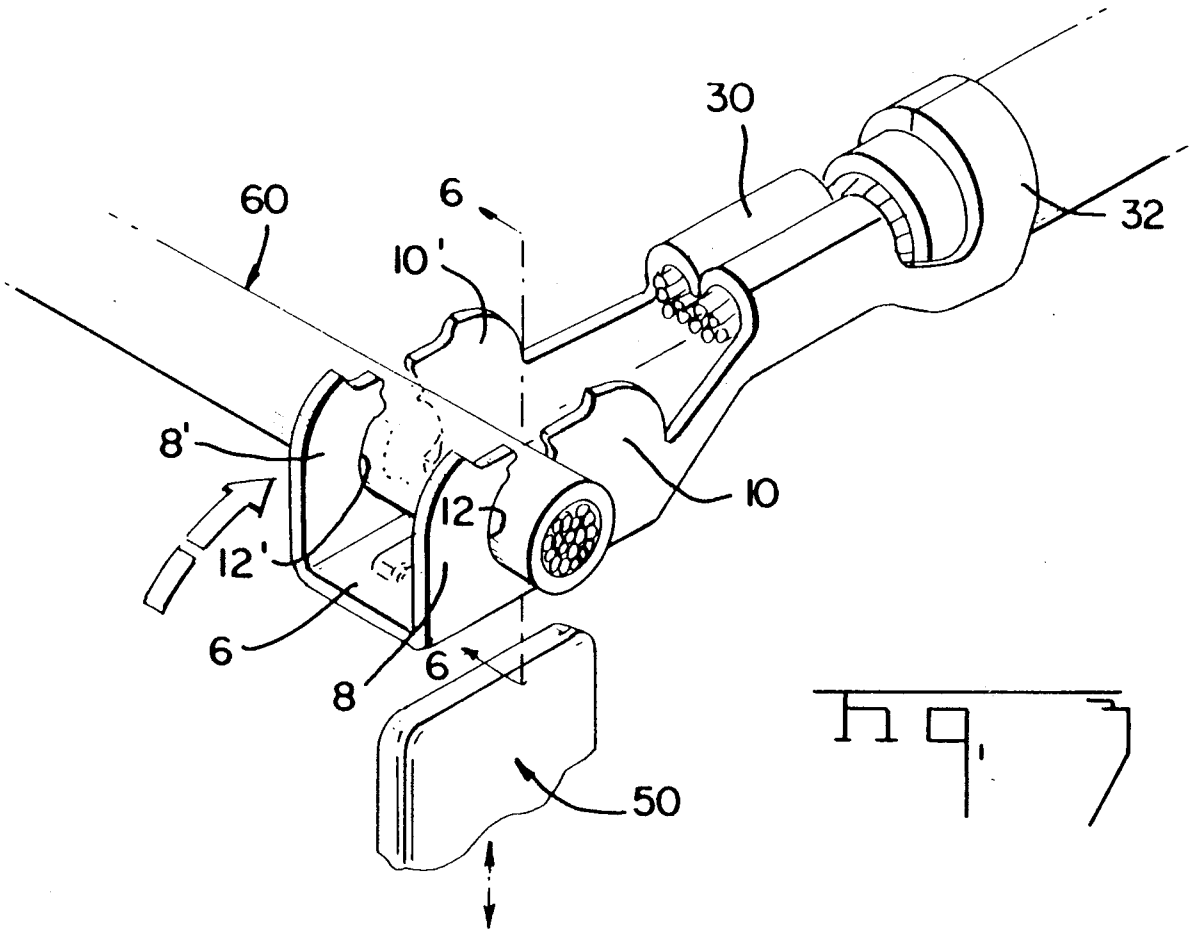
Figure 5:
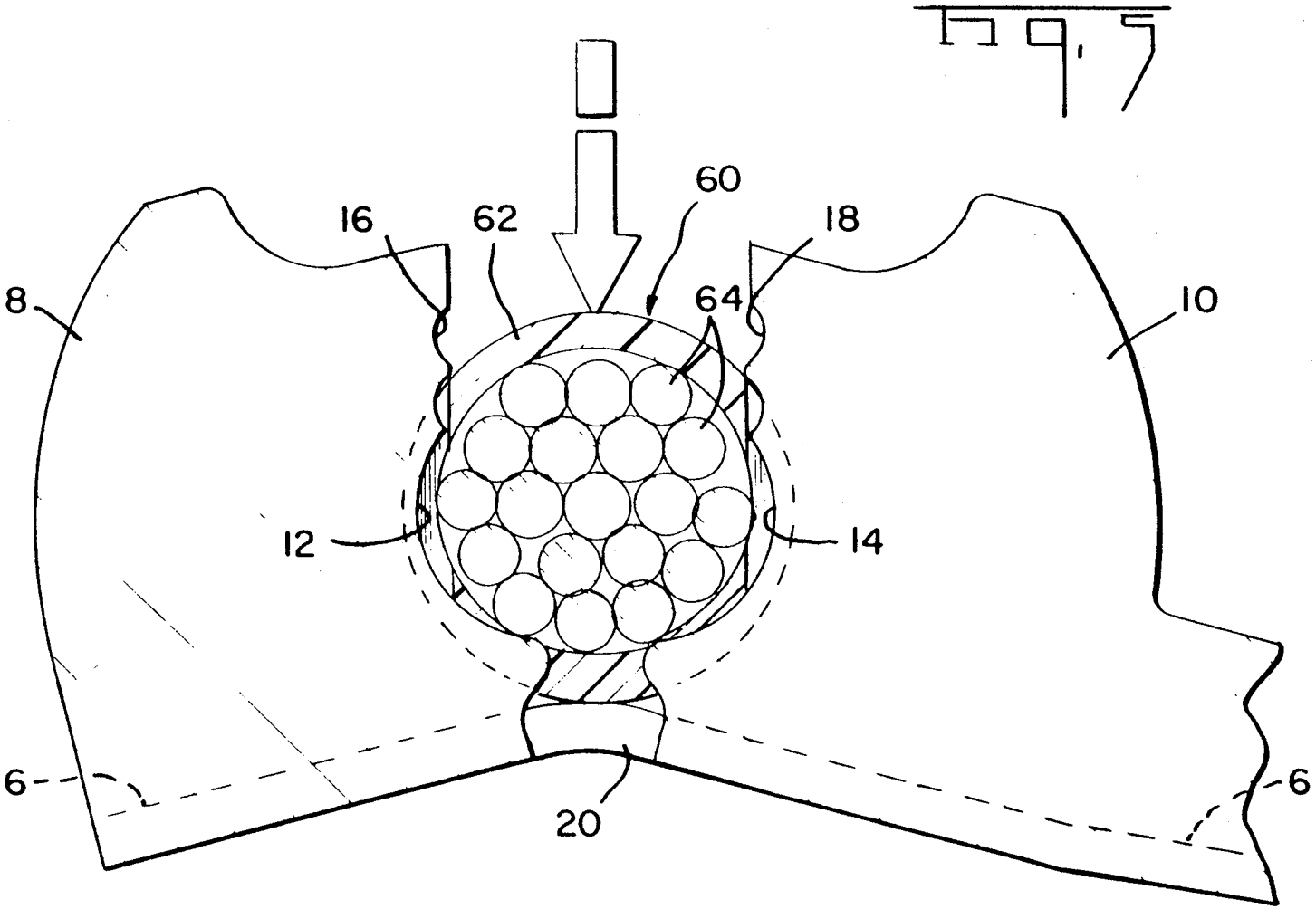
FIG. 5 is a cross-sectional view taken through lines 5—5 of FIG. 2.
Figure 6:
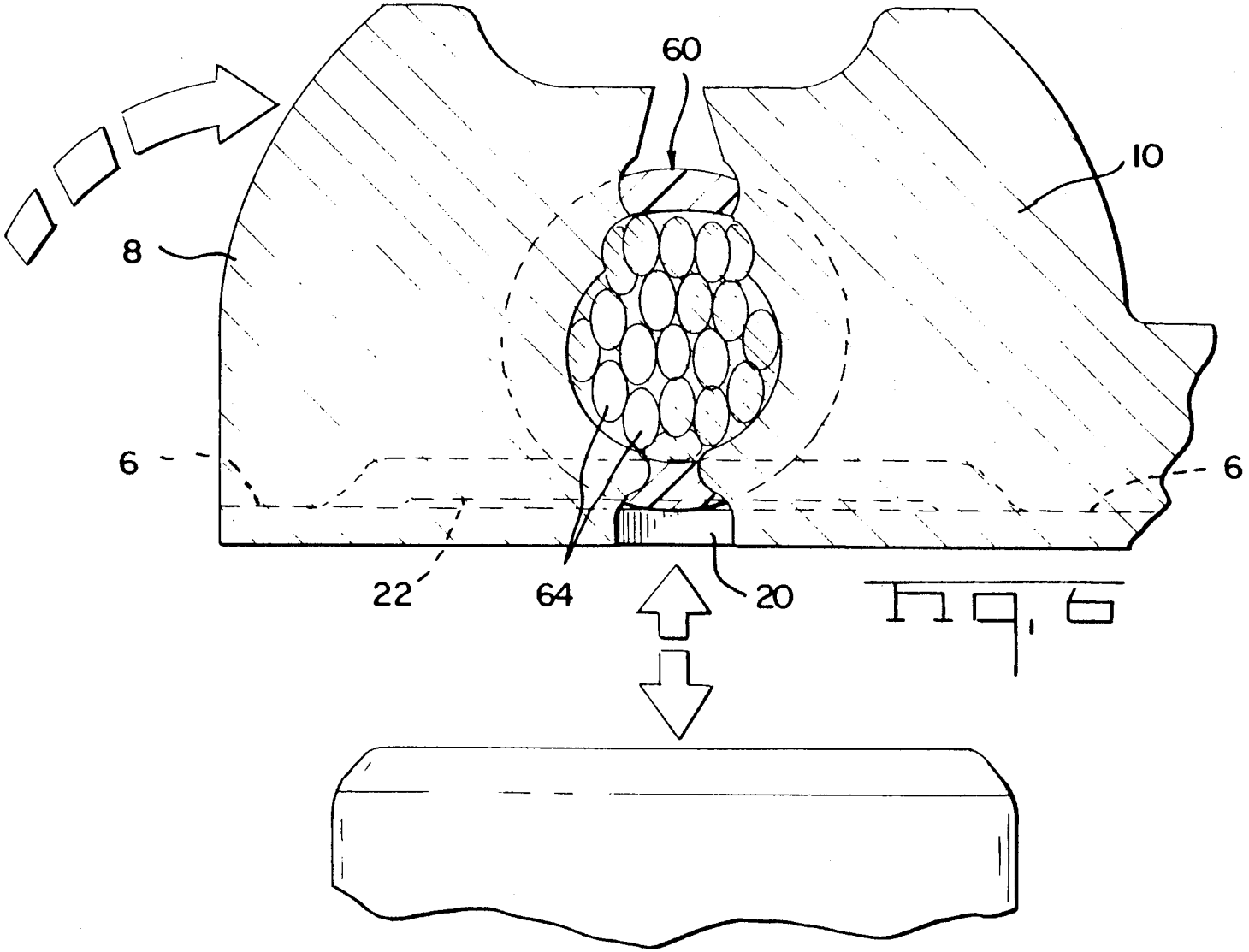
FIG. 6 is similar to the cross-sectional view of FIG. 5 showing the plate portions which form the insulation displacement slot rotated into their final configuration with the multiple strands of wire trapped in the arcuate edges of the plate portions.

To utilize the terminal of the invention, an insulated wire, such as 60, is poised above the insulation displacement slot, as shown in FIG. 1 and is then moved laterally into the slot to a position shown in FIG. 2. The serrated edges 16, 18, as shown in FIG. 4, are profiled for initial severing of the outside diameter of the insulation jacket 62 during the lateral movement of the insulated wire into the slot. When the insulated wire 60 is positioned within the slot, as shown in FIGS. 2 and 5, the base portion 6 can be straightened out to a final position, as shown in FIG. 6, which rotates the plate portions 8, 10 moving the edges 12, 14 closer together. As the side edges 12, 14 of the plate portions 8, 10 are arcuately shaped, the individual strands which form the stranded electrical conductor are confined within the slot by the retention force in the arcuate edges which prevents outward lateral movement of the individual strands. In other words, the individual strands will not rise vertically out of the slot which would cause a discontinuity with the side edges of the slot. This outward lateral movement of individual strands has heretofore been an inherent problem with the termination of multiconductor stranded wires in insulation displacement terminals.

Also as the side edges of the 12, 14 of the plate portions are arcuately shaped, the arcuate edges retain the overall configuration of the individual strands in a generally circular configuration as shown in FIG. 6. This allows the arcuate edges to make direct contact with several conductors while forcing the other stranded conductors together into contact with each other, thereby increasing the conductivity of the termination. Also by forcing the conductors firmly together, such deterrents as oxidation of the conductors is hereby prevented.

In order to prevent anti-rotation of the plate portions 8, 10 about the X—X axis, the underside of the base portion 6 is coined with a coining die 50 to form a deformation in the bottom of the base plate, as shown in FIG. 3. This deformation changes the moment of inertia about the X—X axis which results in a stiffer member about the X—X axis, thereby preventing anti-rotation about the axis.

Figure 7:
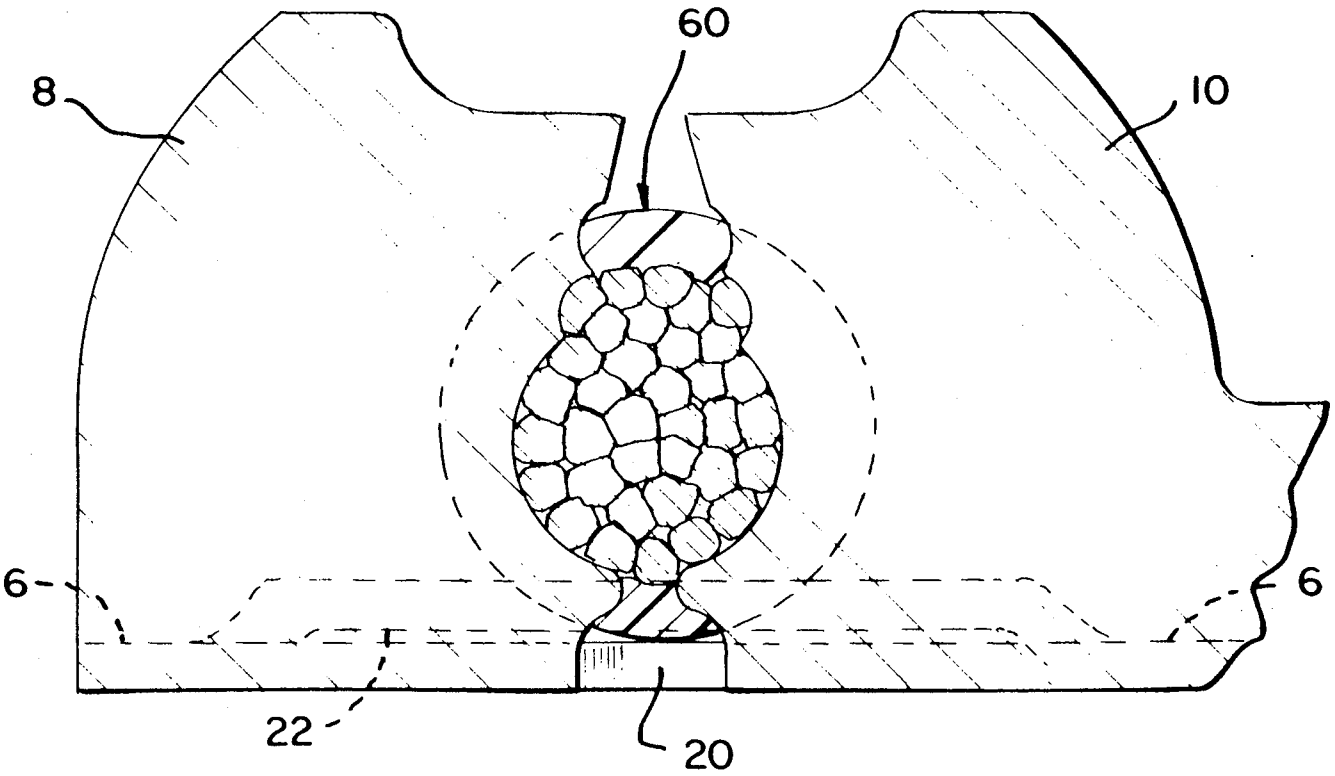
FIG. 7 is a view similar to that of FIG. 6 showing the arrangement of the conductor strands when a cable is terminated having fine conductors.

It should also be noted that any number of conductor strands can be used with the within the slot. For example, FIG. 7 shows a cable having a multitude of strands where the strands are again kept tightly arranged in a bundle in contact with each other and in contact with the side edges of the slot.

It should also be noted that any configuration of terminal is possible with the insulation displacement slot shown herein. For example, the terminal 2 is shown with a crimp barrel such as 30 only for illustrative purposes. The insulation displacement slot could also be integrated with a pin contact, a socket contact, a resilient beam contact, or any other type of contact. The insulation displacement slot of the instant invention can also be used with a plurality of terminals disposed within a connector housing.

We claim:

1. An insulation desplacement type electrical terminal having at least two edges which extend from a base portion to form a slot where an insulated conductor can be moved laterally into the slot for electrical termination, the two edges have arcuately shaped concave surfaces which face each other, the concave surfaces cooperate with the conductor to retain the conductor therebetween, the base portion is coined in a direction along the length to form an elongate recessed section to resist counterbending of the base portion.

2. An electrical terminal as recited in claim 1 wherein the slot is comprised of at least two plate members which are movable one towards the other to decrease the slot width.

3. An electrical terminal as recited in claim 2 wherein the plate members which form the slots include serrations therealong to sever the outer diameter of insulation of the conductor upon lateral movement of the insulated conductor into the slot.

4. An electrical terminal as recited in claim 3 wherein two further plate members extend from the opposite edge of the base portion to form two sets of parallel plate members which define two slots.

5. A method of terminating an insulated wire in a insulation displacement type electrical terminal, the terminal having a base portion with plate members extending therefrom, the plate members have opposing edges provided thereon which define a wire receiving slot, the method comprising the steps of:

moving an insulated wire laterally into the wire receiving slot between the edges of the plate members;

moving the plate members one towards the other to sever the insulation of the insulated wire and to make contact between the edges of the plate members and conductor of the insulated wire; and coining the base portion from an underside thereof in a direction along the length of the base portion to form an elongate recessed section to resist counterbending of the base portion.

6. A method of terminating an insulated wire as recited in claim 5 whereby the coining of the base portion causes the base portion to be straightened relative to the longitudinal axis of the terminal, causing the edges to move toward each other, thereby severing the insulation of the wire and effecting electrical connection between the edges of the plate members and the conductors of the wire.

* * * * *